US005665170A

United States Patent [19]

Lee et al.

[11] Patent Number: 5,665,170

[45] Date of Patent: Sep. 9, 1997

[54] SOLVENT SYSTEM

[75] Inventors: Burnell Lee; William E. Moehle, both of Baton Rouge, La.

[73] Assignee: Albemarle Corporation, Richmond, Va.

[21] Appl. No.: 551,642

[22] Filed: Nov. 1, 1995

[51] Int. Cl.[6] ..... B08B 3/04

[52] U.S. Cl. ..... 134/19; 134/22.14; 134/22.19; 134/25.1; 134/40; 510/273

[58] Field of Search ..... 134/40, 19, 22.14, 134/22.19, 25.1; 252/171, 172

[56] References Cited

U.S. PATENT DOCUMENTS

| | | | |
|---|---|---|---|
| 2,371,645 | 3/1945 | Aitchison et al. | 134/31 |
| 3,730,904 | 5/1973 | Clementson et al. | 252/171 |
| 3,773,677 | 11/1973 | Boyles | 252/172 |
| 3,822,213 | 7/1974 | Johnson | 134/40 |
| 4,056,403 | 11/1977 | Cramer et al. | 134/22 R |
| 4,107,077 | 8/1978 | Sullivan, Jr. et al. | 252/408 |
| 4,193,838 | 3/1980 | Kelly et al. | 162/5 |
| 4,652,389 | 3/1987 | Moll | 252/90 |
| 4,900,456 | 2/1990 | Ogilvy | 252/8.551 |
| 5,102,573 | 4/1992 | Han et al. | 252/153 |
| 5,190,678 | 3/1993 | Swartz et al. | 252/18 |
| 5,207,953 | 5/1993 | Thorssen et al. | 252/601 |
| 5,221,362 | 6/1993 | Porte et al. | 134/40 |
| 5,320,683 | 6/1994 | Samejima et al. | 134/40 |
| 5,350,457 | 9/1994 | Kitazawa et al. | 134/40 |
| 5,403,507 | 4/1995 | Henry | 252/170 |
| 5,492,645 | 2/1996 | Oshima et al. | 252/171 |

FOREIGN PATENT DOCUMENTS

| | | |
|---|---|---|
| 0609004 | 8/1994 | European Pat. Off. . |
| 6128591 | 5/1994 | Japan . |
| 7150196 | 6/1995 | Japan . |
| 7150197 | 6/1995 | Japan . |
| 7292393 | 11/1995 | Japan . |

OTHER PUBLICATIONS

Dipsol Chemicals Co., Ltd., Product Brochure entitled "Dipsol Sc-52A—Cleaning Agent Substitute for Freon and Chlorine Solvents", date unknown, pp. 1-13 (w/translation —pp. 1-17).

Abstract—Great Britain Patent No. 1276783-A, publication date unknown, assigned to Imperial Chemical Inds Lt, entitled "Stabilised trichloroethane— containing nitromethane heterocyclic nitrogen compounds".

Abstract—Japanese Patent No. 03173835-A published Jul. 29, 1991, assigned to Asahi Glass, entitled "New stabilising (pseudo) azetropic tri: cloro: di: fluoroethane composition useful as substitute freon and for heat transfer medium, foaming agent and precision instrument parts".

Kirk-Othmer *Encyclopedia Of Chemical Technology*, "Blood, Coagulants and Anticoagulants to Cardiovascular Agents", Third Edition, vol. 4, (1978), John Wiley & Sons, Inc., New York, pp. 256, 257, 262.

NFPA 325 —National Fire Protection Association, Inc., *Guide to Fire Hazard Properties of Flammable Liquids, Gases, and Volatile Solids*, 1994 Edition, prepared by the Technical Committee on Classification and Properties of Hazardous Chemical Data, pp. 325-1 -325-94.

Dipsol Chemicals Co., Ltd., Product Brochure (No translation).

*Primary Examiner*—Jill Warden
*Assistant Examiner*—Sharidan Carrillo
*Attorney, Agent, or Firm*—E. E. Spielman, Jr.

[57] ABSTRACT

This invention relates to non-stabilized or at least only lightly stabilized n-propyl bromide-based solvent systems which are suitable for use in the presence of metals which normally and easily catalyze the dehydrobromination of brominated hydrocarbons, such as isopropyl bromide.

11 Claims, No Drawings

SOLVENT SYSTEM

BACKGROUND OF THE INVENTION

This invention relates to the stabilization of n-propyl bromide against the corrosion of metals in contact therewith.

n-Propyl bromide has long been recognized as a solvent suitable for degreasing and cleaning metal and plastic articles. See *Kirk-Othmer Encyclopedia of Chemical Technology*, 3rd Edition, Vol. 4, Page 257, John Wiley & Sons Inc., 1978. Also, see European Patent Application No. 0 609 004 A1 which discloses the use of n-propyl bromide as a deterging solvent suitable for use in metal degreasing applications. The '004 application additionally notes that brominated hydrocarbons, e.g., n-propyl bromide, are inferior to chlorofluorocarbons and chlorocarbons with respect to chemical stability, i.e., their corrosive effects on certain metals.

Halogenated solvents are notorious for being corrosive to metals such as aluminum, magnesium and titanium. These metals appear to catalyze the dehydrohalogenation of the solvent, which dehydrohalogenation produces halogen acid which in turn attacks the metal, severely corroding it. It has been conventionally taught that brominated solvents, such as n-propyl bromide and isopropyl bromide, are corrosive to metals even at ambient temperatures and that they need to be stabilized with more than 0.1 wt % stabilizer. Typical stabilizers are nitroalkanes, ethers, epoxides and amines. See European Patent Application No. 0 609 004.

It would be desirable if n-propyl bromide could be stabilized with stabilizer amounts less than 0.1 wt % even at temperatures up to and including the boiling point (71° C.) of n-propyl bromide. It would also be desirable if it were discovered than at temperatures up to and below 60° C. that n-propyl bromide did not need any stabilization whatsoever. In either case, savings are realized on the reduction of the amount or complete elimination of stabilizer needed.

The Invention:

This invention relates to a process for cleaning an article, which process comprises: (a) contacting the article for up to about twenty-four (24) hours with unstabilized n-propyl bromide at a temperature up to about 60° C., preferably from about 20° to about 60° C., in the presence of a metal which catalyzes the dehydrobromination of isopropyl bromide at such temperature.

This invention also relates to a process for cleaning an article, which process comprises: (a) contacting the article for up to about twenty-four (24) hours with n-propyl bromide in the presence of a metal which catalyzes the dehydrobromination of n-propyl bromide at a temperature within the range of from about 60° to about 71° C., the n-propyl bromide being stabilized against dehydrobromination with less than about 0.1 wt % stabilizer.

It has now been discovered that unlike most all other brominated lower alkanes, n-propyl bromide is not nearly as corrosive of metals even at high temperatures over long periods of time. As a result of this discovery, it is now possible to confidently stabilize n-propyl bromide with amounts of stabilizer heretofore not believed possible. Further, this discovery makes possible the marketing of unstabilized n-propyl bromide for use at temperatures lower that about 60° C. without concern for metal corrosion. The term "unstabilized n-propyl bromide" is used to connote that those compounds normally thought of as stabilizers for n-propyl bromide are not present in the solvent system or are not present in the solvent system in a stabilizing function.

The stabilizing function is applied in the context of washing an article at a temperature at or below 60° C. for a period of time under twenty-four (24) hours. As can be seen from the following Examples, for such a washing, n-propyl bromide is not in need of stabilization and, thus, cannot be the subject of stabilization whether stabilizers are present or not. Of course, it is most preferred that the solvent system be essentially free of stabilizers or that none be added thereto. A solvent system in which no solvent is present or in which only very minor non-functional amounts are present is preferred as there is, at the very least, a cost savings realized. The prior art reports that stabilizer functional amounts exceed 0.1 wt % and that lesser amounts are not functional.

The metal referred to in the above is any metal capable of catalyzing the dehydrobromination of isopropyl bromide under the recited conditions. Exemplary metals are aluminum, magnesium and titanium which may be the sole metal or which may be present as a constituent metal in an alloy or amalgam. Isopropyl bromide is chosen to indicate the dehydrobromination activity of the metal as it is an isomer of n-propyl bromide and it exemplifies typical dehydrobromination of brominated compounds in the presence of such metals. Thus, if isopropyl bromide experiences dehydrobromination in the presence of a metal, then that metal can be considered to offer a potential catalytic effect towards other brominated species.

Corrosion of fresh aluminum by nearly pure n-propyl bromide does not occur until the temperature is above 60° C. and the exposure time is twenty-four (24) hours. At ambient temperatures, little or no corrosion is seen. Thus, for exposure to temperatures less than about 60° C., there is no need for stabilization of the n-propyl bromide. At higher temperatures, which are equal to or higher than about 60° C. and up to about 71° C., less than about 0.1 wt % stabilizer is needed to attenuate the corrosive effect of n-propyl bromide. Preferred amounts of stabilizer range from about 0.05 to less than about 0.1 wt %. Another preferred range is from about 0.045 to about less than 0.09 wt % stabilizer. Most preferred are amounts within the range of from about 0.05 to about 0.09 wt %. (The wt % is based upon the total weight of stabilizer and n-propyl bromide.)

Any of the conventional stabilizers which are taught by the art to be useful in stabilizing halogenated hydrocarbon solvents are suitable for the purposes of this invention. The stabilizer may be a simple stabilizer or a combination of stabilizers. The stabilizers can be nitroalkanes, ethers, epoxides, amines or any combination thereof. Preferred are the nitroalkanes, epoxides and combinations thereof. Most preferred is the combination of nitromethane and 1,2-epoxybutane.

The nitroalkanes usable in the present invention include nitromethane, nitroethane, 1-nitropropane, 2-nitropropane and nitrobenzene. Preferred is nitromethane. They are usable either singly or in form of a mixture of two or more of them.

The ethers include 1,2-dimethyoxyethane, 1,4-dioxane, 1,3-dioxalane, diethyl ether, diisopropyl ether, dibutyl ether, trioxane, alkyl cellosolves in which the alkyl group has 1 to 10 carbon atoms such as methyl cellosolve, ethyl cellosolve and isopropyl cellosolve, acetal, acetone dimethyl acetal, γ-butyrolactone, methyl t-butyl ether, tetrahydrofuran and N-methylpyrrole. They are usable either singularly or in the form of a mixture of two or more of them.

The epoxides include epichlorohydrin, propylene oxide, butylene oxide, cyclohexene oxide, glycidyl methyl ether, glycidyl methacrylate, pentene oxide, cyclopentene oxide and cyclohexene oxide. Preferred is 1,2-epoxybutane. They are usable either singularly or in the form of a mixture of two or more of them.

The amines include hexylamine, octylamine, 2-ethylhexylamine, dodecylamine, ethylbutylamine, hexylmethylamine, butyloctylamine, dibutylamine, octadecylmethylamine, triethylamine, tributylamine, diethyloctylamine, tetradecyldimethylamine, diisobutylamine, diisopropylamine, petnylamine, N-methylmorpholine, isopropylamine, cyclohexylamine, butylamine, isobutylamine, dipropylamine, 2,2,2,6-tetramethylpiperidine, N,N-di-allyl-p-phenylenediamine, diallyamine, aniline, ethylenediamine, propylenediamine, diethylenetriamine, tetraethylenepentamine, benzylamine, dibenzylamine, diphenylamine and diethylhydroxyamine. They are usable either singularly or in the form of a mixture of two or more of them.

When designing a solvent system of this invention for general use, it would be prudent to include the small amount of stabilizer mentioned above as the end-use temperature of the solvent system may exceed 60° C. If, on the other hand, the practitioner knew that the end-use would not exceed 60° C. for twenty-four (24) hours, then the solvent system would not require the use of a stabilizer for the n-propyl bromide.

Since it is only the n-propyl bromide that is the focus of the stabilization aspects of this invention, it should be understood that if other halogenated hydrocarbons are co-present with the n-propyl bromide, then those hydrocarbons will need to be stabilized in accordance with the significance of their presence. In the production of n-propyl bromide, there can be co-produced minor amounts of other brominated propanes, especially isopropyl bromide. If the presence of these other brominated propanes is not attenuated, then their corrosive nature has to be accounted for and, if deemed necessary, stabilizer used. The amount of stabilizer used to stabilize these other brominated propanes can be the conventional amount, e.g., from above 0.1 wt % to 15 wt %, with the wt % being based upon the total weight of the other brominated propane and stabilizer used for that particular brominated propane.

Generally, crude n-propyl bromide product will be 99+wt % brominated propane, 90 wt % being n-propyl and the remainder being about 10 to 0 wt % other brominated propanes and very minor amounts of impurities. The impurities that may be found are exemplified by n-propanol, isopropanol, diisopropyl ether, di-n-propyl ether, butyl bromide, ethyl bromide, and the like. The impurities generally account for no more than about 0.2 wt % of the n-propyl bromide product. Preferred processes produce a crude n-propyl bromide product containing at least 94–96 wt % n-propyl bromide and about 4–6 wt % isopropyl bromide and very minor amounts of other impurities, be they brominated compounds or not. Purified n-propyl bromide can contain at least 98 wt % n-propyl bromide and preferred, high purity n-propyl bromide can contain 99+wt % n-propyl bromide with the remainder being isopropyl bromide and other impurities. As an example, a crude n-propyl bromide product containing 95 wt % and 4.5 wt % isopropyl bromide and being used at a temperature less than 60° C., would not need stabilizer for the n-propyl bromide but would need, say 5 wt %, stabilizer for the isopropyl bromide. (This last wt % being based upon the total weight of isopropyl bromide and stabilizer used.) Thus, the total stabilizer loading for the whole of the crude product would only be 5 wt % of the 4.5 wt % or only about 0.237 wt % stabilizer, based upon the total weight of crude product and stabilizer. As can be appreciated such a loading is extremely low and would be of economic and, perhaps, toxicological advantage. If the crude product is destined for use at say 71° C., then the total loading would the above 0.237 wt % plus the less than 0.1 wt % used to stabilize the n-propyl bromide.

When using purified n-propyl bromide, say 98 wt % n-propyl bromide or above, the amount of other brominated propanes may be so low in the destined use that the significance of their corrosive effect may be inconsequential and, thus, there may be no need in taking into account these brominated propanes for corrosion purposes. This phenomena is clearly evident in the for 99.5 wt % n-propyl bromide. In this case, the product would be stabilized in accordance with this invention as if it were 100 wt % n-propyl bromide.

It is also to be understood that n-propyl bromide may be used in combination with a halogenated co-solvent, such as bromochloromethane, 1,1,1-trichloroethane, tri- and perchloroethylene, n-butyl bromide, isobutyl bromide, n-amyl bromide, n-decyl bromide, allyl bromide, hexylene bromide and generally most other solvents of the formula $C_nH_{2n+1-a}X_a$ or $C_mH_{2m-2-a}X_a$ wherein n is 3 to 10 and m is 2 to 10 and a is 1,2 or 3 and X is chlorine or bromine. It is preferred that X be exclusively bromine. Irrespective of the co-solvent used, its needs for stabilization will need to be met. However, once again, the n-propyl bromide's stabilization needs need only be met in accordance with this invention.

Non-halogenated co-solvents may also be used in combination with n-propyl bromide and may be of significant benefit as most should not need stabilization as is generally required of the non-n-propyl bromide halogenated co-solvents. Such non-halogenated co-solvents include those hydrocarbons having a solvent utility in combination with n-propyl bromide. By the term "hydrocarbon", it is meant a compound which contains essentially all hydrogen and carbon constituents, except that it may also contain some oxygen, sulfur and/or nitrogen constituents. The solvent utility concerns mainly solvating fats, waxes, resins, greases, oils and the like. Exemplary hydrocarbons are hexane, benzene, toluene, cyclohexane, terpenes, such as pinene, limonene, carene, and camphene, acetone, methanol, ethanol, isopropanol, methylethyl ketone and mixtures of any two or more of the foregoing. Generally, the co-solvent hydrocarbons can be found in the following classes: alkanes, alkenes, cycloalkanes, cycloalkenes, aromatics, alcohols, ketones, esters, ethers, amines, mineral oils and derivatives and mixtures of the foregoing. Most preferred of the non-halogenated co-solvents are hexane and the terpenes.

Irrespective of whether or not the co-solvent is halogenated, generally it will comprise from about 10 to about 90 wt % of the co-solvent system, with the balance of solvent being n-propyl bromide. If the co-solvent is a non-halogenated hydrocarbon solvent, then the only stabilization generally needed will be that previously described for n-propyl bromide product. Generally, the co-solvent will be present in an amount within the range of from about 25 to about 75 wt %, and preferably within the range of from about 40 to about 60 wt %. The wt % for the co-solvent/n-propyl bromide combination is based upon the total weight of solvent present.

The n-propyl bromide-based solvents of this invention are particularly useful in deterging metal products and electronic parts. The product or part can be dipped in the solvent system which is at a temperature below its boiling point. Also, the solvent systems of this invention can be used as a vapor to effect cleansing of the products or parts. In general, the solvent systems of this invention are suitable for use in all those applications which have been found suitable for chlorinated hydrocarbon solvents, e.g., 1,1,1-trichloroethane, trichloroethylene, perchloroethylene and the like. It is a particular benefit of the solvent systems of this invention that they function well without or at least with reduced amounts of stabilizer than is taught by the prior art.

In describing the temperature at which the solvent systems of this invention may be used, it is noted that most degreasing and cleaning operations are operated at atmosphere pressure. At atmospheric pressure the boiling point will be about 71° C. depending upon the elevation of the operation's location. Thus, vapor operations will also occur within the about 71° C. range. Pressurized operations may also be used and it would be expected that the stabilizer requirements of this invention would apply to temperatures up to 80°–85° C.

Even though the contact time mentioned for the processes of this invention is described as being twenty-four (24) hours or less, it is generally desirable that the contact time be kept to a minimum. The preferred contact times are six (6) hours or less with a contact time of less than one (1) hour being most preferred. Depending upon the cleaning duty prescribed for the solvent systems of this invention, contact times less than 0.5 hours may also be suitable. If the article to be cleaned is not heavily soiled, contact times of less than ten (10) minutes may be sufficient.

EXAMPLES

The following tests were run by immersing scratched aluminum strips in a beaker filled with 99.5 wt % pure n-propyl bromide. The n-propyl bromide was kept at the indicated temperature for twenty-four (24) hours unless observable corrosion was observed. The lapsed time to the observation of corrosion was noted. In some of the tests, stabilizer was added to the pure n-propyl bromide. The identity and quantity of the stabilizer is noted in the Table. The wt % stabilizer was based upon the total amount of n-propyl bromide and stabilizer present.

EXAMPLES I–VIII

| Example No. | Stabilizer | Temperature (°C.) | Observation |
|---|---|---|---|
| I | none | 55 | no corrosion after 24 hrs |
| II | none | 60 | no corrosion after 24 hrs |
| III | none | 65 | corrosion after 12 hrs |
| IV | none | 71 | corrosion after 4 hrs |
| V | 0.09 wt % nitromethane | 71 | no corrosion after 24 hrs |
| VI | 0.05 wt % nitromethane | 71 | no corrosion after 24 hrs |
| VII | 0.09 wt % 1,2-epoxybutane | 71 | no corrosion after 24 hrs |
| VIII | 0.045 wt % nitromethane 0.045 wt % 1,2-epoxybutane | 71 | no corrosion after 24 hrs |

We claim:

1. A process for cleaning or degreasing an article, which process comprises:

(a) contacting the article for up to about twenty-four (24) hours with unstabilized n-propyl bromide at a temperature up to about 60° C. in the presence of a metal which metal has sufficient catalytic effect to dehydrobrominate isopropyl bromide at such temperature, thereby cleansing or degreasing the article.

2. The process of claim 1 wherein the temperature is within the range of from about 20° to about 60° C.

3. The process of claim 1 wherein the metal is aluminum, magnesium or titanium.

4. The process of claim 1 wherein the contacting occurs over a period of time less than about twenty-four (24) hours.

5. A process for cleaning or degreasing an article, which process comprises:

(a) contacting the article for up to about twenty-four (24) hours with stabilized n-propyl bromide in the presence of a metal which catalyzes the dehydrobromination of n-propyl bromide at a temperature within the range of from about 60° to about 71° C., the n-propyl bromide being stabilized against dehydrobromination with less than about 0.1 wt % stabilizer the wt % being based upon the total weight of stabilizer and n-propyl bromide, thereby cleansing or degreasing the article.

6. The process of claim 5 wherein the contacting occurs at a temperature up to about the sea-level boiling point of n-propyl bromide.

7. The process of claim 5 wherein the metal is aluminum, magnesium or titanium.

8. The process of claim 5 wherein the contacting occurs over a period of time less than about twenty-four (24) hours.

9. The process of claim 5 wherein the stabilizer is present in an amount within the range of from about 0.05 to less than about 0.1 wt %.

10. The process of claim 5 where the stabilizer is selected from the group consisting of nitromethane, 1,2-epoxybutane and a mixture thereof.

11. The process of claim 5 wherein the stabilizer comprises from about 0.045 to about less than 0.09 wt % stabilizer.

* * * * *